United States Patent [19]

Schneider

[11] 4,238,120

[45] Dec. 9, 1980

[54] SEALING DEVICE FOR SINTER COOLER

[75] Inventor: Gunter Schneider, Eschborn, Fed. Rep. of Germany

[73] Assignee: Dravo Corporation, Pittsburgh, Pa.

[21] Appl. No.: 61,031

[22] Filed: Jul. 26, 1979

[30] Foreign Application Priority Data

Oct. 11, 1978 [DE] Fed. Rep. of Germany ..... 2844227

[51] Int. Cl.[3] ..... F27B 21/02

[52] U.S. Cl. ..... 266/179

[58] Field of Search ..... 266/179

[56] References Cited

U.S. PATENT DOCUMENTS

| | | | |
|---|---|---|---|
| 3,172,936 | 3/1965 | Koontz | 266/179 |
| 3,655,174 | 4/1972 | Veith | 266/179 |
| 3,987,738 | 10/1972 | Korting | 266/179 |

FOREIGN PATENT DOCUMENTS

| | | | |
|---|---|---|---|
| 694373 | 9/1964 | Canada | 266/179 |
| 1126811 | 9/1968 | United Kingdom | 75/3 |

*Primary Examiner*—P. D. Rosenberg

*Attorney, Agent, or Firm*—Parmelee, Miller, Welsh & Kratz

[57] ABSTRACT

A seal for a bulk material circular cooler includes arcuate sections of flat, horizontally disposed rings directed inward from each upper side edge of the wind boxes. Horizontally disposed outwardly directed ring-shaped flanges depending from both arcuate bottom edges of the rotating cooler frame extend outward underneath these arcuate sections. Arcuate sealing strips mounted on the underside of the arcuate sections bear against the upper surface of the ring-shaped flanges to form a sliding seal between the wind boxes and the cooler frame. The arcuate sections are bendable in the vertical direction and the weight of these sections and the sealing strips is sufficient to overcome the overpressure of cooling air bearing against the underside of the arcuate sections to maintain the seal.

3 Claims, 3 Drawing Figures

SEALING DEVICE FOR SINTER COOLER

FIELD OF THE INVENTION

The invention concerns a circular cooler for hot lumpy material, comprised of a ring-shaped frame supported on two circular rails by means of wheels and moving on these rails, bottom plates mounted to the frame and permeable to gas which fold down for the purpose of material discharge into track recesses, wind boxes located underneath the frame and the bottom plates to supply cooling air, and slide seals to seal the gap between the upper edges of the wind boxes and the bottom side of the frame.

PRIOR ART

Hot bulk material, especially sinter ejected from sinter machines, for example, has to be cooled down before it is further transported, generally on rubber belt conveyors. This is executed in part by circular coolers of the type described. With these circular coolers the gap between the upper edge of the stationary wind boxes and the bottom side of the rotating frame must be sealed as efficiently as possible; otherwise, a large volume of the cooling air will escape through this gap rather than being forced through the plates which are permeable to gas and onto the hot bulk material on these plates.

From German Pat. No. 1,197,482 it is known to seal the gap by attaching downward extending gaskets to the frame which, acting as a slide seal, rest against the upper edge of the rim of a sealing plate attached to the wind boxes. In order to counteract the overpressure present, the gaskets have to be pressed against the sealing plate with pretension. Any decrease in the pretension or any wear will result in leaks. Furthermore, the runners and rails are exposed to dust and are inacccessible during operation.

From German Pat. No. 1,068,469 it is known to seal this gap with the help of sliding plates. This type of seal, however, is only possible with coolers where the cooling air is suctioned through the material from above and therefore the slide plates, due to the negative pressure, are drawn up to form a seal.

A known process for circular sintering machines is to seal the lateral gaps with hydraulic seals (German Pat. No. 2,322,915). This type of seal requires great mechanical and operational expenditure.

For circular sintering machines, it is also known to provide a seal with the help of continuous strips made of a pliable synthetic material, which are fastened to the wind boxes and are pressed against the bottom side of the grate cars due to the negative pressure in the wind boxes (German Pat. No. 2,435,158). This type of seal is suited only for cooling with upward pull. In addition to this, a strong frictional resistance is experienced.

Also known for circular sinter machines are spring-type gaskets which seal the stationary gas box against the lateral walls (British Pat. No. 1,126,811). The design of the spring units, however, requires great expenditure, especially in the case of circular machines. Furthermore, they are affected by dust penetration.

A number of seals are known for straight sintering machines (German Pat Nos. 1,508,475, 2,053,977, 1,117,882, 1,758,983, 1,803,583; U.S. Pat. No. 3,172,936; Canadian Pat. No. 694,373). To use this type of seal for circular coolers would in part require considerable expenditure, result in an insufficient seal and also considerable wear.

SUMMARY OF THE INVENTION

The invention is based on the concept of creating a simple sealing device permitting free movement of the cooler without affecting the sealing effect.

According to this invention, this problem is solved in that at the upper edge of the wind boxes or an extension of the upper edge of the wind boxes there are circular-shaped segments horizontally mounted with their outer edge, that the ring-shaped segments are designed to slightly bend upward and downward, that underneath the interior wall of each segment a sealing strip is attached, the sealing strips rest on a horizontal ring-shaped flange on the frame and that the weight of the sealing strips pulls down the segment against the existing overpressure on the bottom side of the section until the sealing strip is in contact with the flange. The term "slightly bendable" means that the sections demonstrate a certain upward and downward flexibility, but are practically stable without any external influence. They might consist, for example, of adequate rubber material or thin sheet metal. The required elasticity may also be obtained with rigid material which is attached to the upper edge of the wind boxes in an elastic mounting. The sealing strips preferably should consist of steel sections or other wear resistant materials. The sealing strip weight required to pull the segments downward may also be produced by applying weighted material, such as sheet metal strips, to the sealing strips or the segments.

A preferred design has the feature that the length of the ring-shaped segments is limited so that the tangent to the center of the inner circle, determined by the sealing strip, at the ends of the segments does not pass through the outer circle, determined by the upper edge of the wind boxes. Consequently, an especially effective sealing effect is obtained.

One preferred design has the feature that the sealing strips are in the shape of blocks. The rectangular block design of the sealing strip produces an effective seal under any conditions, and wear and tear is relatively low.

DESCRIPTION OF THE DRAWINGS

The figures serve to give examples of the invention in more detail.

DESCRIPTION OF THE PREFERRED EMBODIMENT

Figure 1:
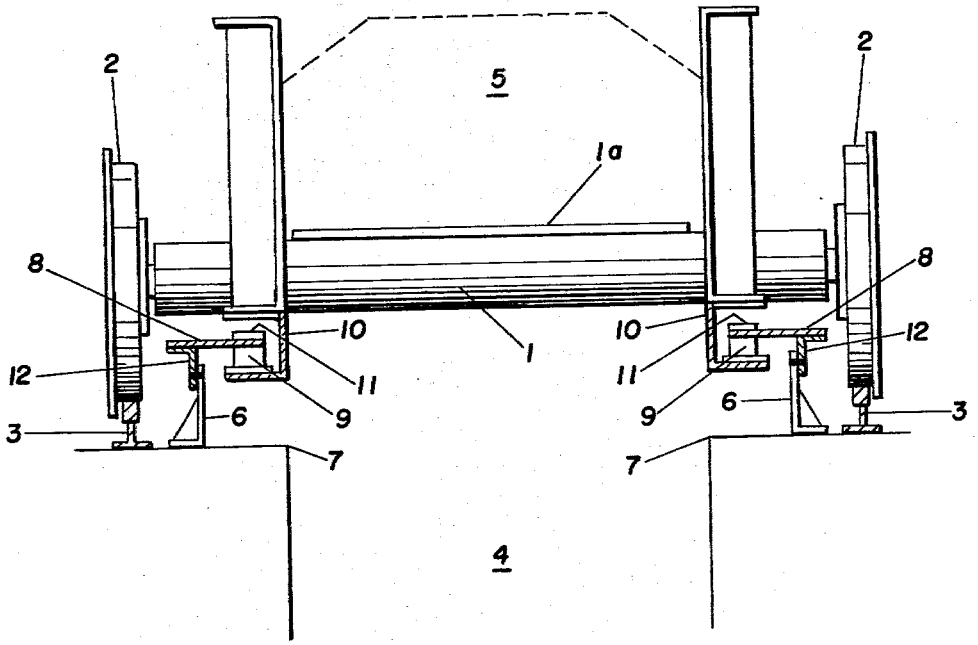
FIG. 1 represents a schematic cross-section of the cooling trough.

The ring-shaped frame 1 is supported on two circular rails 3 by means of wheels 2 and with the help of these wheels 2 runs on the tracks. Located underneath the frame 1 are wind boxes 4 through which the cooling air is supplied and forced through the feed 5 resting on as permeable bottom plates 19. Ring-shaped segments 8 are mounted horizontally with their outer edge connected to the extension 6 of the upper edge 7 of the wind boxes 4. Underneath the inner edge of segments 8 one sealing strips 9 each is attached. A flange 10 is attached to the frame 1, sealing strips 9 are resting on the former.

Figure 2:
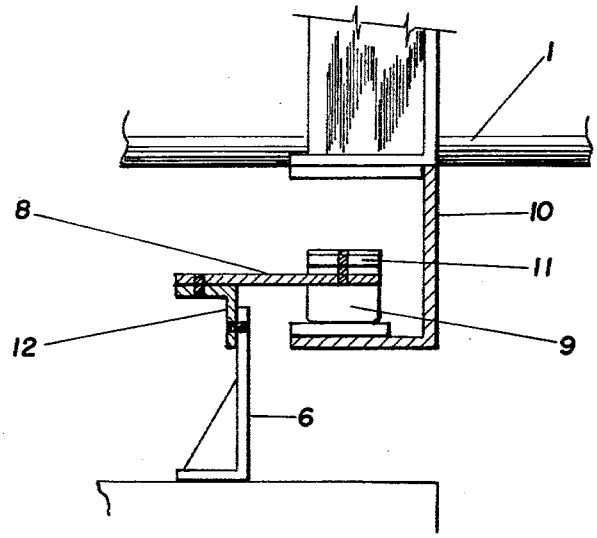
FIG. 2 shows a magnification of the seal.

In FIG. 2 metal sheet weights 11 are applied on top of the sealing strips 9 on segment 8. An angle 12 at the extension 6 to which sealing strip 9 is attached allows the latter to be adjusted up or down.

Figure 3:
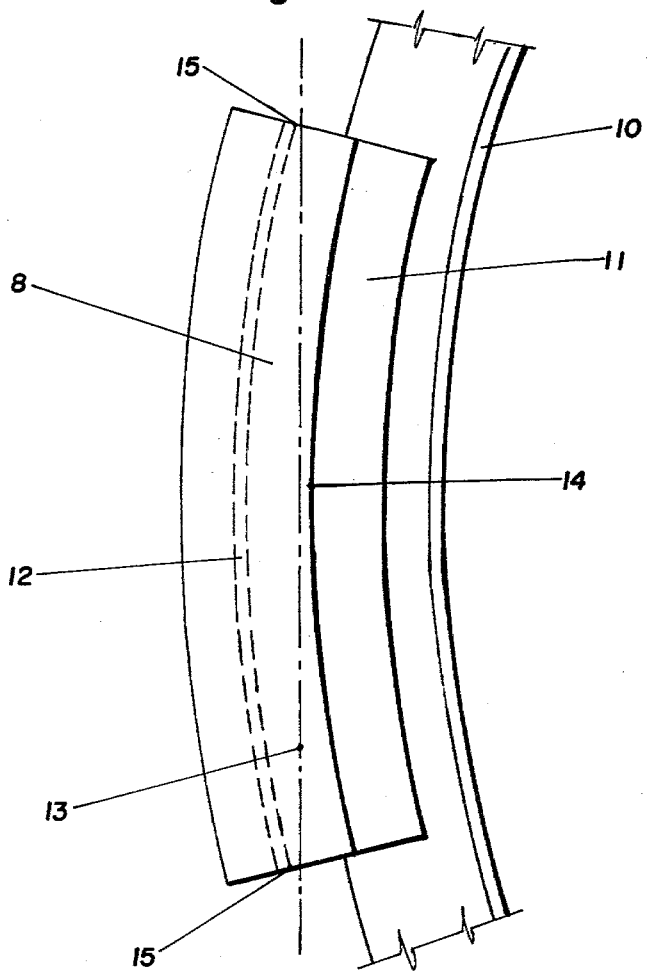
FIG. 3 is a top view of a section of the seal.

FIG. 3 illustrates that the tangent 13 to the center of the inner circle 14 does not pass through the outer circle 15. The distance of tangent 13 at the ends of segments 8 from the outer circle 15 can be chosen at random. The contact points of the segments may be protected.

The advantages of the invention are that by means of a single seal an effective seal is obtained regardless of the movement of the cooler, the seal is not affected by dust, wear is relatively low, and the seal may be easily installed and repaired.

What is claimed is:

1. In a circular cooler for hot material in lump form comprising a ring-shaped frame supported for circular movement on a pair of circular rails, bottom plates permeable to gas mounted to the frame for supporting the hot material in the cooler, wind boxes located under the frame and bottom plates for supplying cooling air up through the bottom plates and the hot material for cooling the latter and sliding seals for preventing the escape of said cooling air between the upper edges of the wind boxes and the bottoms sides of the ring-shaped frame, said sealing means comprising:

arcuate sections of flat, horizontally disposed rings cantilevered along one arcuate edge thereof inward toward each other from adjacent the upper edges of both arcuate sides of the wind boxes;

horizontally disposed outwardly directed ring-shaped flanges depending from both arcuate bottom edges of said frame and extending outward underneath said arcuate sections; and arcuate sealing strips mounted on the underside of said arcuate sections and bearing against the upper surface of said ring-shaped flanges to form a sliding seal between the wind boxes and cooler frame, said cantilevered arcuate sections being bendable in the vertical direction and the weight of the arcuate sections and of the sealing strips being sufficient to overcome the overpressure of cooling air bearing against the underside of the arcuate section to maintain the sealing strips in sealing contact with the flanges.

2. The sealing means of claim 1 wherein said sealing strips are mounted on the cantilevered arcuate sections adjacent the free arcuate edge thereof, and wherein the length of the arcuate sections is limited such that a straight line may be drawn from one end edge of each arcuate section to the other across and wholly within the portion of the arcuate section lying between the inner edge of the wind box and the edge of the sealing member closest thereto.

3. The railing means of claim 1 or 2 wherein the sealing strips are in block form.

* * * * *